US005743770A

United States Patent [19]

Hamai

[11] Patent Number: 5,743,770

[45] Date of Patent: Apr. 28, 1998

[54] CONNECTOR

[75] Inventor: Tsuyoshi Hamai, Shizuoka, Japan

[73] Assignee: Yazaki Corporation, Tokyo, Japan

[21] Appl. No.: 698,453

[22] Filed: Aug. 15, 1996

[30] Foreign Application Priority Data

Sep. 13, 1995 [JP] Japan ..... 7-235473

[51] Int. Cl.[6] ..... H01R 13/514

[52] U.S. Cl. ..... 439/752.5

[58] Field of Search ..... 439/752.5, 408, 439/595

[56] References Cited

U.S. PATENT DOCUMENTS 4,557,543 12/1985 McCleerey et al. ..... 439/408

5,569,051 10/1996 Endo et al. ..... 439/752.5

5,626,499 5/1997 Yagi et al. ..... 439/752.5

*Primary Examiner*—Gary F. Paumen

*Assistant Examiner*—T. C. Patel

*Attorney, Agent, or Firm*—Morgan, Lewis & Bockius LLP

[57] ABSTRACT

A connector includes a press-clamping terminal having an insulative sheath clamping portion (which has upwardly projecting, clamping piece portions) for fixedly clamping an insulative sheath of a wire, a connector housing having a terminal receiving chamber for receiving the press-clamping terminal, and a terminal fixing member removably attached to the connector housing so as to abut against rear ends of the clamping piece portions in the inserting direction to hold the press-clamping terminal in the terminal receiving chamber. A pair of guide portions for allowing the clamping piece portions to move only in the terminal-inserting direction are formed on an inner surface of the terminal receiving chamber in the connector housing.

6 Claims, 4 Drawing Sheets

CONNECTOR

BACKGROUND OF THE INVENTION

1. Field of the Invention

This invention relates to a connector for connecting electric wiring, and more particularly to an improved connector in which when mounting a press-clamping terminal in a connector housing, the inclination of the press-clamping terminal in the connector housing is limited so that the connector can be properly fitted.

2. Background

Conventionally, various types of connectors for connecting an electric wiring have been used, and in one such known connector, a terminal, connected to one end of a wire, is mounted in a terminal receiving chamber in a connector housing, and then a terminal fixing member, mounted removably on the connector housing, is abutted against the terminal, thereby retaining the terminal in the housing against withdrawal.

One such example is a connector 1 shown in FIG. 4. This connector 1 includes a press-clamping terminal 20 connected to one end of a wire 10, and a connector housing 2 having a terminal receiving chamber 4 for holding the press-clamping terminal 20 therein.

The press-clamping terminal 20 is a male terminal formed by pressing a thin metal sheet into the predetermined shape, as shown in FIG. 5. This press-clamping terminal 20 includes a contact end portion 21 in the form of a flat plate for fitting in a mating female terminal (not shown), a pair of upstanding piece portions 22 provided rearwardly of the contact end portion 21, a conductor embracing portion 23 for fixedly embracing a conductor 11 of the wire 10, and an insulative sheath clamping portion 24 for embracing and clamping an insulative sheath 12 of the wire 10.

The insulative sheath clamping portion 24 includes a pair of clamping piece portions 25 whose proximal portions are bent or curved into intimate contact with the outer surface of insulative sheath 12 to embrace the wire 10. Distal end portions of the clamping piece portions 25 are connected or mated together at their distal ends above the wire 10 to assume a wedge-like configuration, thus forming an upwardly-projecting, retaining projection of the insulative sheath clamping portion 24.

The connector housing 2 is injection molded of an insulative synthetic resin, and has a hollow shape. This connector housing 2 has at its front end portion a fitting recess 3 for receiving a housing of a mating connector. An elastic retaining piece portion 5 for engagement with the upstanding piece portions 22 to retain the press-clamping terminal 20 in the connector housing 2 is formed at a front end of the terminal receiving chamber 4 provided adjacent to the fitting recess 3.

A terminal fixing member 6 for engagement with the distal ends of the clamping piece portions 25 to hold the press-clamping terminal 20 in the connector housing 2 is formed through a flexible hinge 7 on an upper surface of the connector housing 2 at a rear end thereof. Thus, the double retaining can be achieved so that the connector housing 2 can hold the press-clamping terminal 20, retained by the elastic retaining piece portion 5, with a greater force.

More specifically, the upwardly-projecting, clamping piece portions 25 of the insulative sheath clamping portion 24 are retained by the terminal fixing portion 6, and by doing so, the double retaining construction is achieved without increasing the overall length. Therefore, the connector 1, though having the double retaining construction, can be compact in construction.

The clamping piece portions 25 of the insulative sheath clamping portion 24, which are mated together at their distal ends above the wire 10 to assume a wedge-like configuration, are varied in height (H), depending on the degree of clamping thereof, and therefore in order that the terminal can be smoothly inserted into the terminal receiving chamber 4, a gap (t) must be provided between the clamping piece portions 25 and the inner surface of the top wall of the connector housing 2, as shown in FIG. 6.

Therefore, the press-clamping terminal 20 is hardly inserted straight into the terminal receiving chamber 4, so that the posture of the terminal from its rear end to its front end is liable to be inclined in the insertion space. As a result, the contact end portion 21 for fitting in the mating female terminal (not shown) is not located in the proper position, and the two connectors are fitted together with the contact end portion 21 thus kept in the inclined condition, and therefore the connector fitting force is increased, so that the connectors may not be smoothly fitted together.

The clamping piece portions 25 of the insulative sheath clamping portion 24 have a large play relative to the inner surface of the connector housing 2, and can rotate in directions indicated by arrows in FIG. 6. Therefore, the amount of engagement of the terminal fixing member 6 with rear ends 25*a* of the clamping piece portions 25 in the inserting direction is reduced, so that the double retaining may not be effected positively.

SUMMARY OF THE INVENTION

An object of this invention is to overcome the above problems, and more specifically to provide a connector of a compact construction in which when mounting a press-clamping terminal in a connector housing, the inclination of the press-clamping terminal is limited so that the fitting of the connector can be effected satisfactorily.

The above object of the present invention has been achieved by a connector including a press-clamping terminal having an insulative sheath clamping portion for fixedly clamping an insulative sheath of a wire, and a connector housing having a terminal receiving chamber for receiving the press-clamping terminal, the insulative sheath clamping portion having an upwardly projecting, retaining projection. Guide portions for allowing the retaining projection to move only in a terminal-inserting direction are formed on an inner surface of the terminal receiving chamber in the connector housing.

The above object has also been achieved by the connector in which a terminal fixing member is removably attached to the connector housing so as to abut against a rear end of the retaining projection in the inserting direction to hold the press-clamping terminal in the terminal receiving chamber.

Preferably, the retaining projection is defined by clamping piece portions of the insulative sheath clamping portion which are mated together at their distal ends above the wire to assume a wedge-like configuration.

DETAILED DESCRIPTION OF THE PREFERRED EMBODIMENTS

Figure 6:
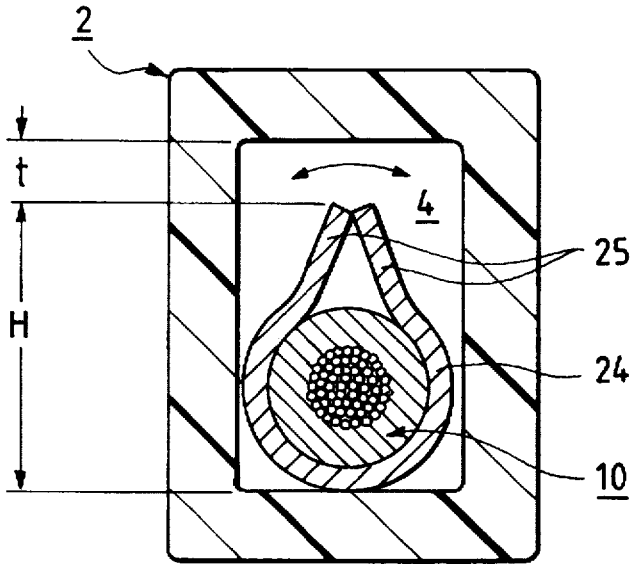
FIG. 6 PRIOR ART
FIG. 6 is a transverse cross-sectional view of the connector of FIG. 4.

A preferred embodiment of a connector of the present invention will now be described in detail with reference to the drawings. A press-clamping terminal 20 of this embodiment is similar to the conventional press-clamping terminal 20 of FIG. 6, and identical portions will be designated by identical reference numerals, respectively, and detailed explanation thereof will be omitted.

The connector 100 of this embodiment includes the press-clamping terminal 20 connected to one end of a wire 10, and a connector housing 30 having a terminal receiving chamber 32 for holding the press-clamping terminal 20 therein.

The connector housing 30 is injection molded of an insulative synthetic resin, and has a hollow shape. This connector housing 30 has a fitting recess 31 for receiving a housing of a mating connector at a front end portion thereof. An elastic retaining piece portion 33 for engagement with upstanding piece portions 22 of the press-clamping terminal 20 to retain the press-clamping terminal 20 in the connector housing 30 is formed at a front end of the terminal receiving chamber 32 provided adjacent to the fitting recess 31.

A notch or opening 34 is formed in a rear end portion of the connector housing 30, and communicates with the terminal receiving chamber 32. A pair of guide portions 35 and 35 for allowing clamping piece portions 25 of the press-clamping terminal 20 to move only in a terminal-inserting direction are formed on an upper surface of that portion of the terminal receiving chamber 32 disposed adjacent to the notch 34, and extend in the terminal-inserting direction. A terminal fixing member 36 for engagement with rear ends 25*a* of the clamping piece portions 25 in the inserting direction to hold the press-clamping terminal 20 in the connector housing 30 is formed through a flexible hinge 37 on an upper surface of the connector housing 30.

Figure 1:
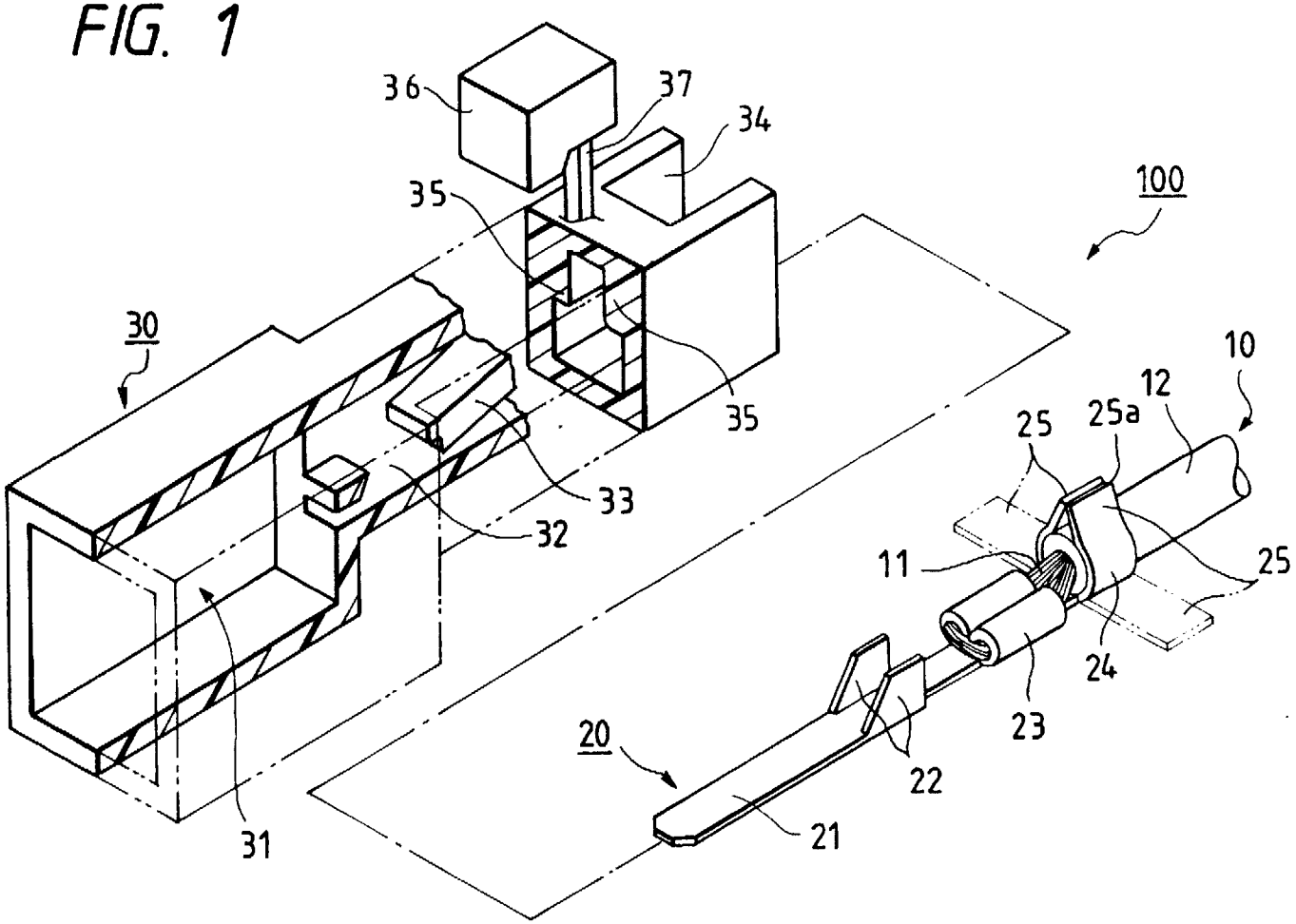
FIG. 1 is a partly-broken, exploded perspective view of a preferred embodiment of a connector of the present invention.
Figure 2:
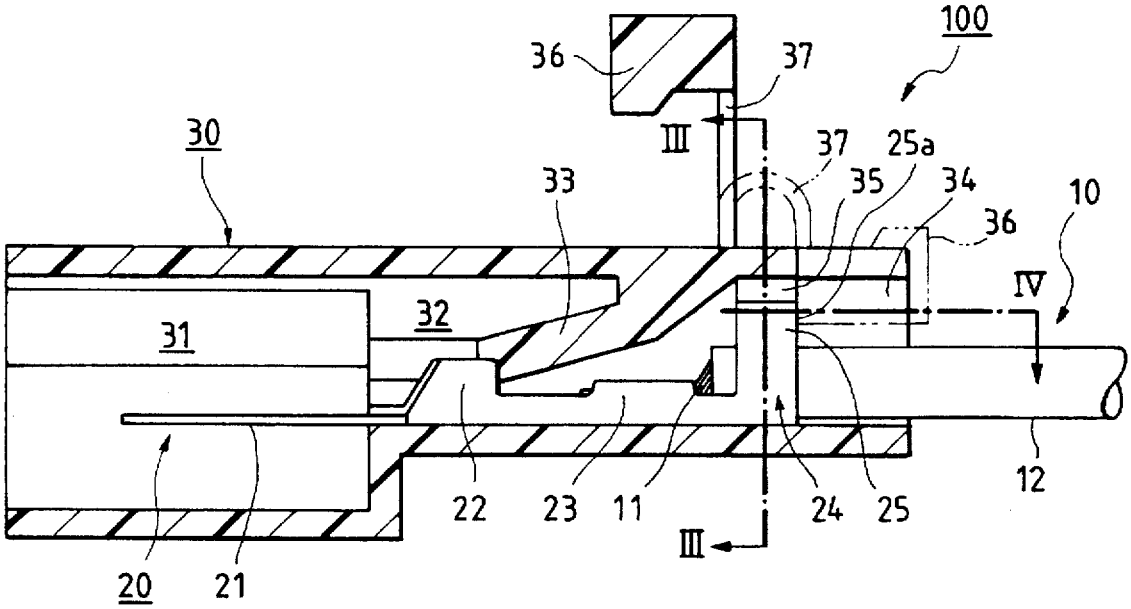
FIG. 2 is a longitudinal cross-sectional view of the connector of FIG. 1.

When the press-clamping terminal 20 is inserted into the connector housing 30 of the above construction, so that a contact end portion 21 of the press-clamping terminal 20 is projected into the fitting recess 31, the elastic retaining piece portion 33 of the connector housing 30 engages the upstanding piece portions 22 of the press-clamping terminal 20, thereby retaining the press-clamping terminal 20 in the connector housing 30, as shown in FIG. 2.

Figure 3:
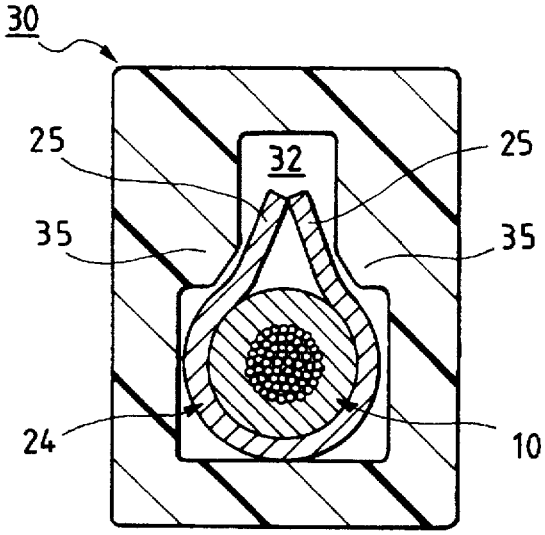
FIG. 3 is a cross-sectional view taken along the line III—III of FIG. 2.
Figure 4:
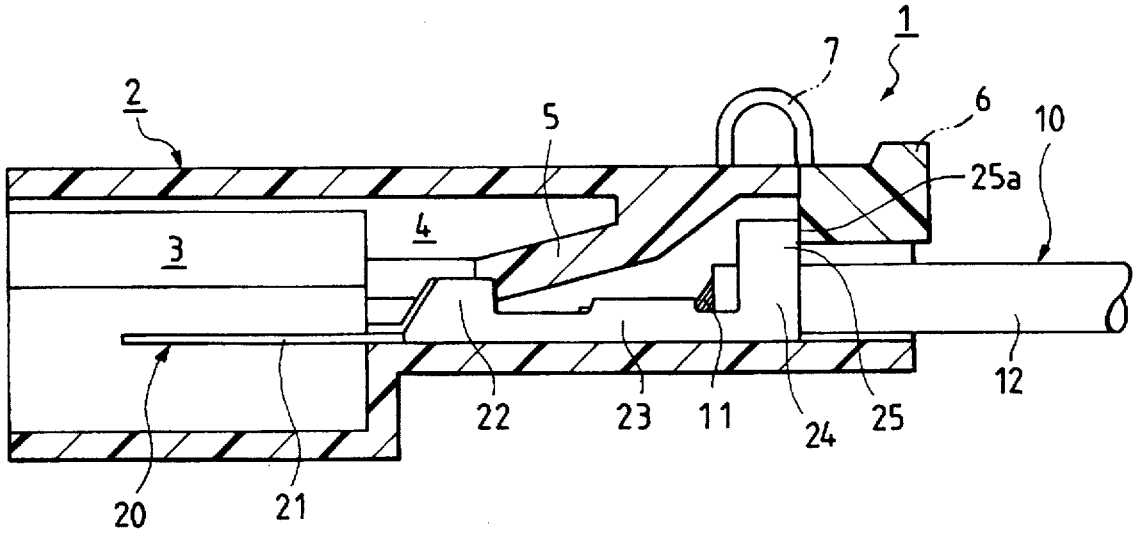
FIG. 4 PRIOR ART
FIG. 4 is a longitudinal cross-sectional view of a conventional connector.
Figure 5:
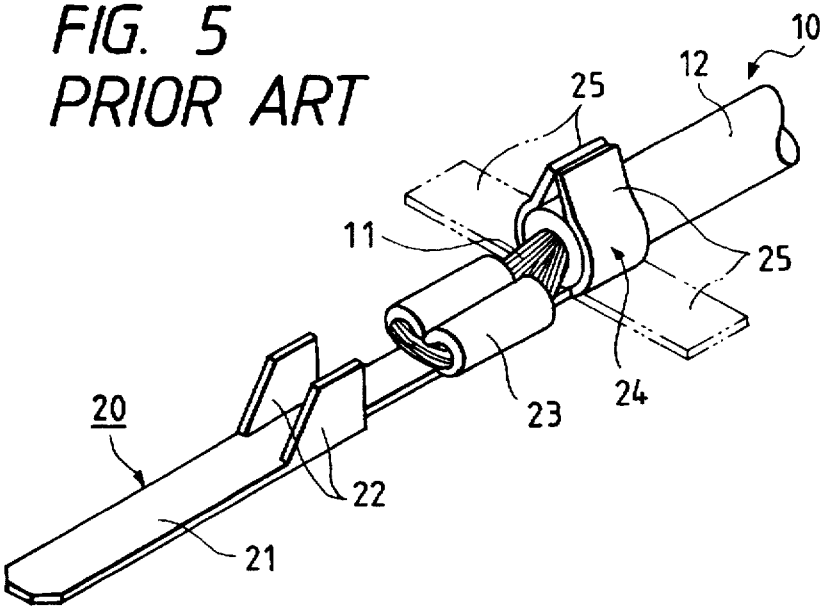
FIG. 5 PRIOR ART
FIG. 5 is a perspective view of a press-clamping terminal shown in FIG. 4.

At this time, the distal ends of the clamping piece portions 25 of the insulative sheath clamping portion 24 are guided by the pair of guide portions 35 and 35 formed on the inner surface of the terminal receiving chamber 32. The clamping piece portions 25 are held between the pair of guide portions 35 and 35 as shown in FIG. 3, and the terminal assumes a straight posture from its rear end to its front end in the insertion space.

Therefore, the two connectors can be fitted together in such a manner that the contact end portion 21, fitted in a mating female terminal, is located in the proper position, and therefore the fitting of the connectors can be effected smoothly without increasing the connector fitting force.

Then, when the terminal fixing member 36 is fitted into the notch 34 with the flexible hinge 37 bent, the terminal fixing member 36 is abutted against the rear ends 25*a* of the clamping piece portions 25 in the inserting direction, so that the press-clamping terminal 20 is retained in a double manner by the elastic retaining piece portion 33 and the terminal fixing member 36, thereby increasing the force of the connector housing 30 holding the press-clamping terminal 20.

At this time, the clamping piece portions 25 of the insulative sheath clamping portion 24 are held by the pair of guide portions 35 and 35, and a play of these portions 25 in the terminal receiving chamber 32 is small, so that the rotation of these portions 25 about the axis of the wire 10 is limited. Therefore, the clamping piece portions 25 will not be inclined in the terminal receiving chamber 32, and therefore the amount of engagement of the terminal fixing member 36 with the rear ends 25*a* of the clamping piece portions 25 in the inserting direction will not be reduced.

Thus, the press-clamping terminal 20 can be positively retained in a double manner by the elastic retaining piece portion 33 and the terminal fixing member 36, and therefore the force of the connector housing 30 holding the press-clamping terminal 20 is enhanced. The upwardly-projecting, clamping piece portions 25 of the press-clamping terminal 20 are engaged with the terminal fixing member 36, thereby achieving the double retaining construction without increasing the overall length, and therefore the connector, though having the double retaining construction, can be of a compact construction.

The present invention is not limited to the connector of the above embodiment, and for example, the retaining projection and the connector housing can be modified in various ways. In the above embodiment, although the press-clamping terminal 20 is retained in a double manner by the elastic retaining piece portion 33 and the terminal fixing member 36, the connector may be of such a construction that the press-clamping terminal 20 is retained only by the retaining piece portion 33 or the terminal fixing member 36. Further, the present invention can be applied to a multi-pole connector having a plurality of juxtaposed terminal receiving chambers.

As described above, in the connector of the present invention, the guide portions for allowing the retaining projection of the insulative sheath clamping portion to move only in the terminal-inserting direction are formed on the inner surface of the terminal receiving chamber in the connector housing. Therefore, when inserting the press-clamping terminal into the terminal receiving chamber, the press-clamping terminal is prevented from being inclined, so that the posture of this terminal is straight from its rear end to its front end in the insertion space.

Therefore, the two connectors can be fitted together in such a manner that the press-clamping terminal, fitted in the mating terminal, is located in the proper position, and therefore the fitting of the connectors can be effected smoothly without increasing the connector fitting force.

The retaining projection of the insulative sheath clamping portion is held by the guide portions formed on the inner surface of the terminal receiving chamber, and a play of this retaining projection in the terminal receiving chamber is small, so that the rotation of this retaining projection about the axis of the wire is limited. Therefore, the retaining projection will not be inclined in the terminal receiving chamber, and therefore the amount of engagement of the terminal fixing member with the retaining projection will not be reduced.

Therefore, the retaining projection of the press-clamping terminal is positively retained by the terminal fixing member, and there can be provided the connection which is highly reliable, and has a compact construction.

What is claimed is:

1. A connector, comprising:

a press-clamping terminal having a sheath clamping portion for clamping an insulative sheath of a wire, said sheath clamping portion having a retaining projection which upwardly projects;

a connector housing having a terminal receiving chamber for receiving said press-clamping terminal; and a pair of guide portions, for guiding said retaining projection, formed on an inner surface of said terminal receiving chamber, said guide portions extending inward from said housing and positioned so as to abut said retaining projection when said press-clamping terminal is inserted into said terminal receiving chamber, said guide portions limiting said retaining projection to move in a terminal-inserting direction.

2. A connector of claim 1, wherein a terminal fixing member is detachably attached to said connector housing to abut against a rear end of said retaining projection in the inserting direction and to hold said press-clamping terminal in said terminal receiving chamber.

3. A connector of claim 2, wherein said retaining projection is defined by a pair of clamping piece portions of said sheath clamping portion which are mated together at their distal ends above said wire to form a wedge-like configuration.

4. A connector of claim 1, wherein said retaining projection is defined by a pair of clamping piece portions of said sheath clamping portion which are mated together at their distal ends above said wire to form a wedge-like configuration.

5. A connector of claim 1, wherein said terminal receiving chamber is defined by a fitting recess for receiving a mating connector, a first retaining port having an elastic retaining piece for retaining said press-clamping terminal and a second retaining port having said guide portions and a terminal hole.

6. A connector of claim 5, wherein said terminal hole of said second retaining port has a guide groove formed with said guide portions, and a hole which is wider than said groove.

* * * * *